US006220230B1

(12) United States Patent
Kawamura et al.

(10) Patent No.: US 6,220,230 B1
(45) Date of Patent: Apr. 24, 2001

(54) EVAPORATIVE EMISSION CONTROL SYSTEM FOR INTERNAL COMBUSTION ENGINE

(75) Inventors: Katsuhiko Kawamura; Akihiro Kawano, both of Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/385,462

(22) Filed: Aug. 30, 1999

(30) Foreign Application Priority Data

Sep. 2, 1998 (JP) ..... 10-248274

(51) Int. Cl.[7] ..... F02M 33/04; F02M 25/08

(52) U.S. Cl. ..... 123/520

(58) Field of Search ..... 123/516, 518, 123/520, 519, 198 D

(56) References Cited

U.S. PATENT DOCUMENTS 5,495,842 * 3/1996 Yamanaka et al. ..... 123/520
5,592,923 * 1/1997 Machida ..... 123/520
5,617,832 * 4/1997 Yamazaki et al. ..... 123/520
5,647,332 * 7/1997 Hyodo et al. ..... 123/520
5,857,447 * 1/1999 Shinohara ..... 123/520

FOREIGN PATENT DOCUMENTS 5-79408 3/1993 (JP) .

* cited by examiner

*Primary Examiner*—Thomas N. Moulis
(74) *Attorney, Agent, or Firm*—Foley & Lardner

(57) ABSTRACT

An evaporative emission control system is provided which includes a bypass valve, purge control valve and a vent control valve. To make a leak diagnosis, firstly the vent control valve is closed while the purge control valve is opened, whereby to negatively pressurize the inside of a fuel vapor conduit portion extending from the bypass valve to an intake pipe side. After the pressure in the fuel vapor conduit portion from the bypass valve to the intake pipe is reduced to a predetermined value, the purge control valve is closed. Then, the bypass valve is opened, and after lapse of a predetermined time from the opening of the bypass valve a variation of pressure in a conduit extending from the fuel tank to the purge control valve is asured. Based on the variation of pressure, a leak diagnosis is made. By this, the evaporative emission control system can prevent the fuel vapor in the fuel tank from being drawn into the intake pipe during reduction of pressure in the conduit and thus causing unstable operation of an engine.

12 Claims, 4 Drawing Sheets

EVAPORATIVE EMISSION CONTROL SYSTEM FOR INTERNAL COMBUSTION ENGINE

BACKGROUND OF THE INVENTION

1. Field of the Invention

The present invention relates in general to evaporative emission control systems for internal combustion engines, and more particularly to an evaporative emission control system of the type which is capable of making a leak diagnosis, i.e., capable of detecting if a leak is present in the evaporative control system.

2. Description of the Related Art

An internal combustion engine for current automotive vehicles includes an evaporative emission control system. The evaporative emission control system includes a canister containing activated charcoal to collect and store volatile fuel vapors from a fuel tank during the time the engine is not inning. The evaporative emission control system also includes a purge line or conduit connecting between an intake pipe portion downstream of a throttle valve and the canister. The purge line opens under a predetermined condition after start of the engine to draw fresh air into the canister and purge the canister. The collected volatile fuel vapors are thus drawn from the canister into the intake pipe, for combustion within a combustion chamber of the engine.

In such an evaporative emission control system, if a conduit between the fuel tank and the intake pipe has a leak or the conduit has a connecting portion of which seal is defective, the fuel vapors are released to the atmosphere. To prevent such evaporative fuel emission, there has been proposed an evaporative emission control system which is adapted to make a leak diagnosis, i.e., which is capable of determining if a leak is present in the evaporative emission control system.

A leak diagnosis can be made by closing the above described conduit in a way as to prevent communication between the inside and outside of the conduit, putting the inside of the thus closed conduit into a condition wherein there is a difference in pressure between the inside and outside of the conduit, and observing a variation of the pressure in the conduit. For example, an evaporative emission control system disclosed in Japanese Patent Provisional Publication No. 5-79408, is adapted to make a leak diagnosis by reducing the pressure in the above described conduit by using an intake vacuum prevailing in an intake pipe portion downstream of a throttle valve during operation of an engine.

SUMMARY OF THE INVENTION

However, the above described prior art evaporative emission control system is constructed so as to communicate the intake pipe directly with the fuel tank at the time of reducing the pressure in the above described conduit, so the fuel vapors in the fuel tank may possibly be drawn into the engine during the time of reducing the pressure in the conduit to cause a variation of the air/fuel ratio and therefore an unstable operation of the engine.

Further, the higher the vehicle speed the more the intake vacuum developed in the intake pipe, so a higher vehicle speed is desirable for reducing the pressure in the conduit. However, a high vehicle speed will increase the pressure in the conduit due to sloshing (i.e., splash of the fuel in the fuel tank causing variations of the fuel surface), thus increasing the possibility of erroneous diagnosis. So, a lower vehicle speed is desirable for making a leak diagnosis. The prior art system is adapted to reduce the pressure in the conduit and make a leak diagnosis irrespective of the vehicle speed, and therefore cannot meet the above two requirements at the same time.

The present invention has been made in view of the above problems inherent in the prior art system and has for its object to provide an evaporative emission control system for an internal combustion engine which is free from a problem that the fuel vapors in the fuel tank are drawn into the engine during reduction of the pressure in the conduit to cause an unstable operation of the engine, and can attain efficient reduction of the pressure in the conduit and a highly reliable leak diagnosis at the same time.

To achieve the foregoing object, the present invention provides an evaporative emission control system for an internal combustion engine including a canister having an atmospheric vent, a first conduit providing communication between a fuel tank and the canister, a second conduit providing communication between the canister and an intake pipe portion downstream of a throttle valve of the engine, a bypass valve disposed between the fuel tank and the canister and mounted on the first conduit for selectively allow and prevent communication between the fuel tank and the canister, a purge control valve disposed between the canister and the intake pipe portion and mounted on the second conduit for selectively allow and prevent communication between the canister and the intake pipe portion, and a vent control valve for selectively opening and closing the atmospheric vent of the canister. The evaporative emission control system includes a pressure reducing device for closing the vent control valve and the bypass valve wile opening the purge control valve for thereby introducing a vacuum prevailing in the intake pipe portion into a portion of the first and second conduits extending between the bypass valve and the intake pipe portion and thereby reducing a pressure in the portion of the first and second conduits to a predetermined value and thereafter closing the purge control valve, a pressure measuring device for opening the bypass valve after reduction of the pressure in the portion of the first and second conduits to the predetermined value and measuring a pressure variation in a portion of the first and second conduits extending between the fuel tank and the purge control valve after lapse of a predetermined time from the opening of the bypass valve, and a diagnostic device for making a leak diagnosis on the basis of the pressure variation measured by the pressure measuring device.

DETAILED DESCRIPTION OF THE EMBODIMENT

Figure 1:
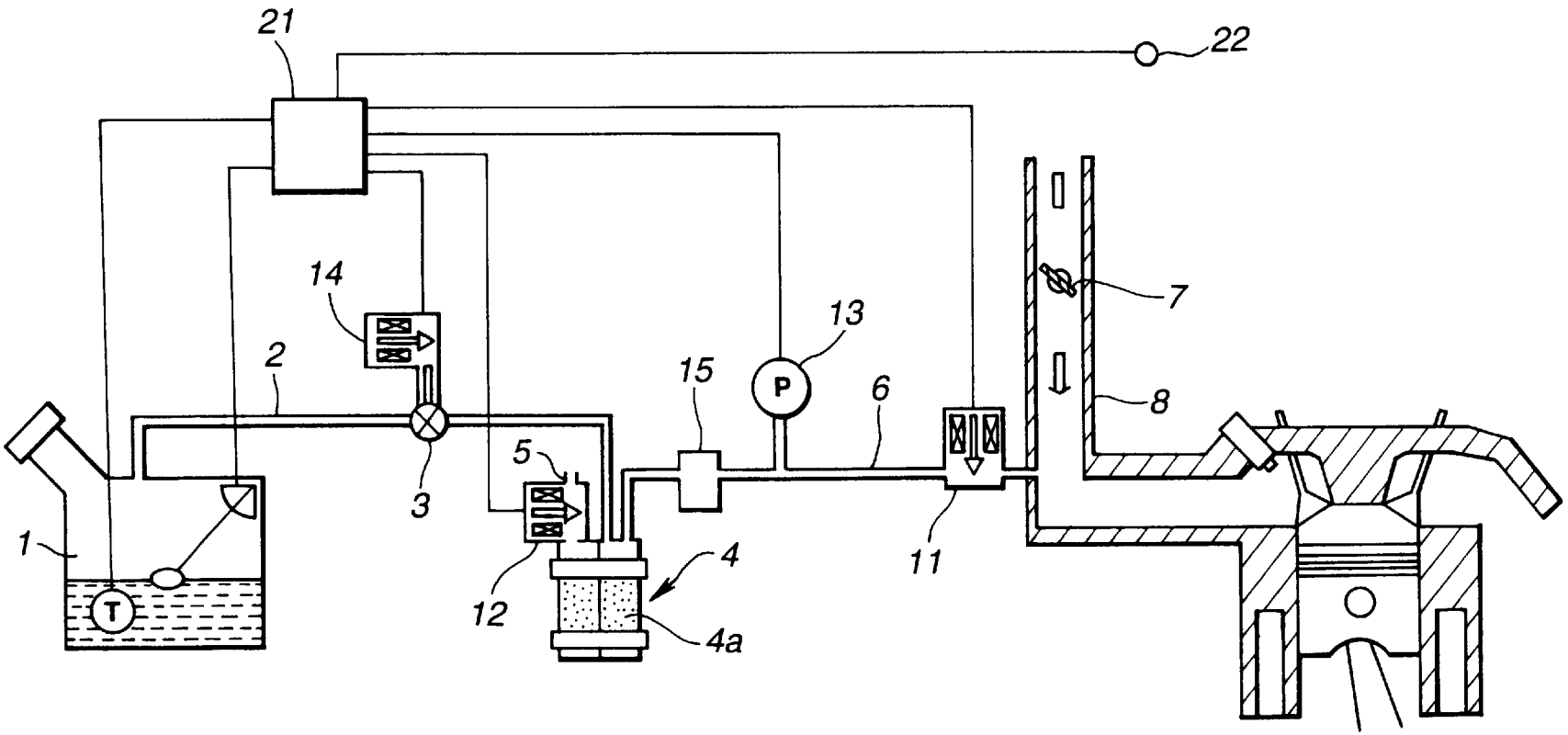
FIG. 1 is a schematic diagram of an evaporative emission control system according to an embodiment of the present invention.

Referring first to FIG. 1, an evaporative emission control system for an internal combustion engine includes a canister 4, a conduit (first conduit) 2 providing communication between the canister 4 and a fuel tank 1 and a conduit (second conduit) 6 providing communication between the canister 4 and an intake pipe 8 portion downstream of a throttle valve 7 of an internal combustion engine.

On the conduit 2 are mounted a vacuum cut valve (check valve) 3 which is adapted to open when the pressure in the fuel tank 1 is lower than the atmospheric pressure and a bypass valve 14 in parallel with the vacuum cut valve 3. The bypass valve 14 is a normally closed valve and is driven by a step motor (not shown)so as to selectively open and close. The bypass valve 14 is adapted to open under a predetermine condition at the time of a leak diagnosis.

On the conduit 6 are mounted a purge control valve 11, a pressure sensor 13 for measuring the pressure in the conduit 6, and a vacuum tank 15 of a predetermined volume for storing vacuum therewithin. The purge control valve 11 is a normally closed valve and is driven by a step motor similarly to the bypass valve 14 so as to selectively open and close. As will be described hereinlater, the purge control valve 11 is opened under a predetermined condition at the time when the collected fuel vapors are drawn from the canister 4 or when a leak diagnosis is made. In the meantime, the vacuum tank 15 may be disposed at any place so long as it is disposed between the bypass valve 14 and the purge control valve 11.

The canister 4 has an atmospheric vent 5. The atmospheric vent 5 is disposed at the lower end of the canister 4 though shown at the upper end in the drawing. A normally open vent control valve 12 is provided to the atmospheric vent 5 of the canister 4. The vent control valve 12 is driven by a step motor (not shown) so as to selectively open and close and is adapted to close under a predetermined condition at the time of a leak diagnosis.

Opening and closing of the above described purge control valve 11, vent control valve 12 and bypass valve 14 is controlled by a microcomputer 21. A signal from the pressure sensor 13 and in addition a signal from a vehicle speed sensor 22 are inputted to the microcomputer 21.

By the above structure, fuel vapors (i.e., air containing evaporative fuel) in the fuel tank 1 are drawn through the conduit 2 to the canister 4 so that only fuel particles are absorbed by an activated charcoal 4*a* in the canister 4 and the remaining air is discharged through the atmospheric vent 5 to the outside.

For processing the fuel absorbed by the activated charcoal 4*a*, the purge control valve 11 is opened to draw fresh air into the canister 4 through the atmospheric vent 5 by utilizing intake vacuum prevailing in the intake pipe 8 portion downstream of the throttle valve 7. The fuel vapors are drawn from the activated charcoal 4*a* together with the fresh air into the intake pipe 8 for combustion in a combustion chamber of the engine.

If the connecting portions of the lines 2 and 6 have a leak or the sealed portion of the fuel tank 1 has a leak, fuel vapors possibly leak out to the atmosphere. To prevent such leakage, a leak detection or diagnosis for determining if a leak is present in the conduit between the fuel tank 1 and the purge control valve 11 is made, by reducing the pressure in the conduit between the fuel tank 1 and the purge control valve 11 through control of the above described purge control valve 11, vent control valve 12 and the bypass valve 14 by means of the microcomputer 12 , on the basis of a variation of pressure measured by the pressure sensor 13.

The process of the leak diagnosis will be described with reference to the flowcharts of FIGS. 2 and 3.

Figure 2:
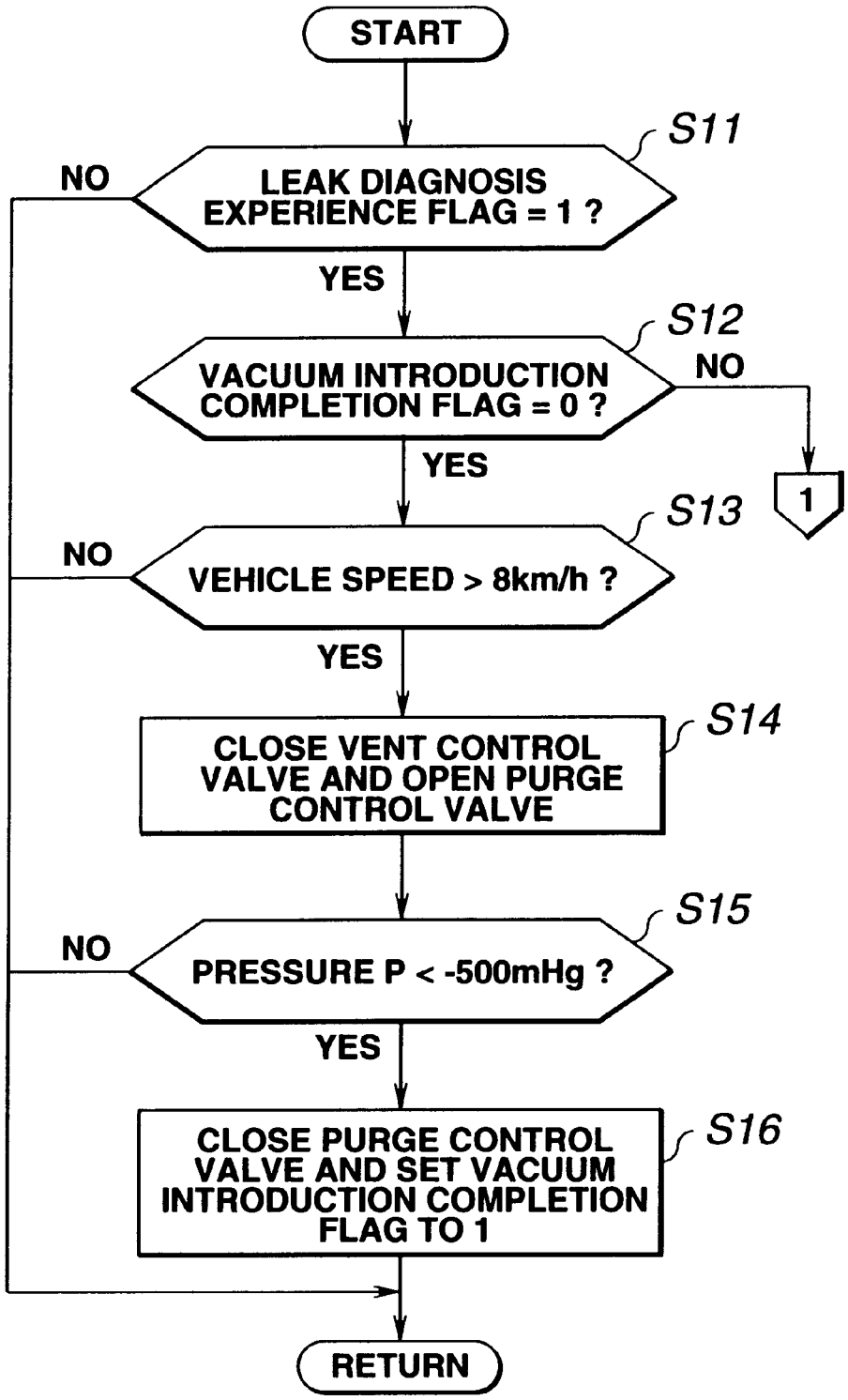
FIG. 2 is a flowchart illustrating a part of the process of leak diagnosis made by the evaporative emission control system of FIG. 1.
Figure 3:
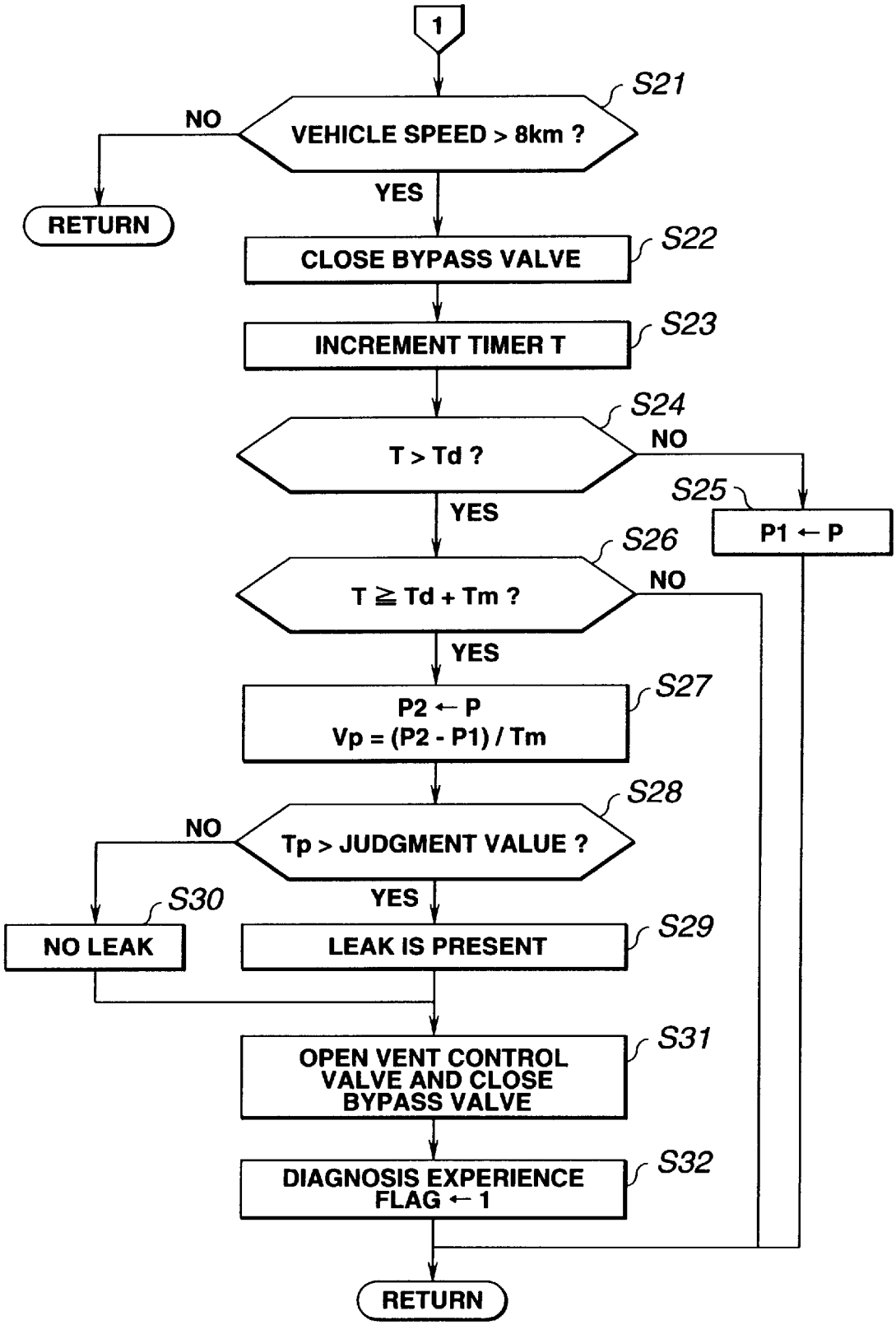
FIG. 3 is a flowchart illustrating another part of the process of leak diagnosis made by the evaporative emission control system of FIG. 1.

The flowcharts of FIGS. 2 and 3 are executed every predetermined time (e.g., every 10 msec) at the microcomputer 12.

Firstly, the flowchart of FIG. 2 will be described. At step S11, the value of a leak diagnosis experience flag is observed. In this instance, the leak diagnosis experience flag is initially set to "0" at start of the engine. After the leak diagnosis has been made, the flag is set to "1". If the value of the leak diagnosis experience flag is "0", the program proceeds to Step S12 to make a leak diagnosis. If the value of the flag is "1", the process is finished since the leak diagnosis has already been made. The standard frequency of leak diagnosis is about one time per each operation of the engine. By making a leak diagnosis only when the value of the leak diagnosis experience flag is "1", the leak diagnosis can be made once per each operation of the engine.

At step S12, the value of a vacuum introduction completion flag is observed. The vacuum introduction completion flag is initially set to "0" at start of the engine. When reduction of the pressure in the conduit between the bypass valve 14 and the purge control valve 11 has been completed, the vacuum introduction completion flag is set to "1". In this instance, if the value of the vacuum introduction completion flag is "0", the program proceeds to step S13 for reduction of the pressure in the conduit between the bypass valve 14 and the purge control valve 11. On the contrary, if the value of the flag is "0", the program proceeds to step S21 to make a leak diagnosis since reduction of the pressure in the conduit between the bypass valve 14 and the purge control valve 11 has been completed.

At step 13, it is judged whether the vehicle speed is higher than a predetermined value (e.g., 8 Km/h) or not. If the vehicle speed is higher than the predetermined value, the program proceeds to step S14 where reduction of the pressure in the conduit between the bypass valve 14 and the purge control valve 11 is performed. If the vehicle speed is lower than the predetermined value, the process is finished without executing the pressure reducing step. The reduction of pressure is performed in the above manner only when the vehicle speed is higher than a predetermined value because a larger vacuum prevails in the intake pipe 8 so that the reduction of pressure can be attained efficiently within a short time.

At step S14, the vent control valve 12 is closed and the purge control valve 11 is opened. Since the bypass valve 14 is a normally closed valve as having described above, a vacuum is introduced from the intake pipe 8 into a portion of the conduits 2 and 6 between the bypass valve 14 and the intake pipe 8.

At step S15, the measurement pressure P measured by the pressure sensor 13 is observed. If the measurement pressure P is lower than a predetermined pressure (e.g., −500 mmHg), the program proceeds to step S16 where the purge control valve 11 is closed and the value of the vacuum introduction completion flag is set to "1". On the contrary, if the measurement pressure P is higher than the predetermined value, the program returns to start so that steps S11–S14 for the reduction of pressure are repeated until the measurement pressure P becomes lower than the predetermined value.

Accordingly, by the program shown in FIG. 2, when a leak diagnosis has not yet been made and the vehicle speed is higher than a predetermined value, the steps S11–S14 for the reduction of pressure are performed until the pressure in the conduit between the bypass valve 14 and the purge control valve 11 becomes −500 mmHg or less. When the reduction of pressure is completed, the process proceeds to step S21 of the program of FIG. 3.

Then, the program of FIG. 3 will be explained.

Firstly, at step S21, it is judged whether the vehicle speed is lower than a predetermined value (e.g., 8 Km/h). If the vehicle speed is lower than the predetermined value, the program proceeds to step S22 where a leak diagnosis is made. On the contrary, if the vehicle speed is higher than the predetermined value, the process is finished without making a leak diagnosis. If the vehicle speed is higher than the predetermined value, the quantity of fuel vapors is increased rapidly by sloshing to increase the pressure in the fuel tank 1, resulting in a possibility of making an erroneous judgement that a leak is present though there is no leak actually. By making a leak diagnosis in the above manner, i.e., only when the vehicle speed is lower than a predetermined value, such an erroneous judgement can be avoided beforehand.

At step S22, the bypass valve 14 is opened to introduce the vacuum in the portion of the conduits 2 and 6 between the purge control valve 11 and the bypass valve 14 into a portion of the conduit 2 between the fuel tank 1 and the bypass valve 14.

At step S23, the timer T is incremented. The timer T is set to "0" at start of the engine and measures the lapse of time from opening of the bypass valve 14 after reduction of the pressure in the portion of the conduits between the bypass valve 14 and the purge control valve 11.

At step S24, the value of the timer T is compared with a predetermined delay time Td. When the value of the timer T is smaller than the delay time Td, the program proceeds to step S25 where the measurement pressure P of the pressure sensor 13 is stored as a parameter P1. When the value of the timer T exceeds the delay time Td, the program proceeds to step S26 where a leak detection is made. The delay time Td is provided to wait till the flow of vacuum to the fuel tank 1 side is completed so that the pressure in the portion of the conduits 2 and 6 between the fuel tank 1 and the purge control valve 11 becomes stable. In the meantime, finally stored as the parameter P1 is the measurement pressure P which is obtained when the value of the timer T becomes equal to the delay time Td.

At step 26, the value of the timer T is compared with the sum of the delay time Td and the measurement time Tm. When the value of the timer T becomes larger than the sum of the value of the timer T and the measurement time Tm, the program proceeds to step S27. When the value of the time T is smaller than the sum of the value of the timer T and the measurement time Tm, the program returns to start. Accordingly, it is after further lapse of the measurement time Tm from the time when the delay time Td has elapsed that the program proceeds to step 27.

At step S27, the measurement pressure P at that time is stored as a parameter P2, and a pressure variation speed Vp (=(P2−P1)/Tm) is calculated by using the previous parameter P1 and the measurement time Tm.

At step S28, the pressure variation speed Vp is compared with a reference value. If a leak is present, the pressure increases within a short time due to drawing of air into the conduits 2 and 6, that is, the pressure variation speed Vp becomes larger. When the pressure variation speed Vp is larger than a reference value, the program proceeds to step S29 where it is judged that a leak is present. When the pressure variation speed Vp is smaller than a reference value, the program proceeds to step S30 where it is judged that no leak is present.

In this manner, when the leak diagnosis has been made, the vent control valve 12 is opened and the bypass valve 14 is closed at step S31. At step 32, the leak diagnosis experience flag is set to "1" and then the program is finished.

According to the flowchart of FIG. 3, the bypass valve 14 is opened when the vehicle speed becomes lower than a predetermined value to introduce vacuum into the portion of the conduit 2 between the bypass valve 14 and the fuel tank 1. When the resulting pressure variation comes to an end after lapse of a predetermined time, a variation of the pressure in the conduit 6 is measured and a leak diagnosis is made based on the measured pressure variation.

Figure 4:
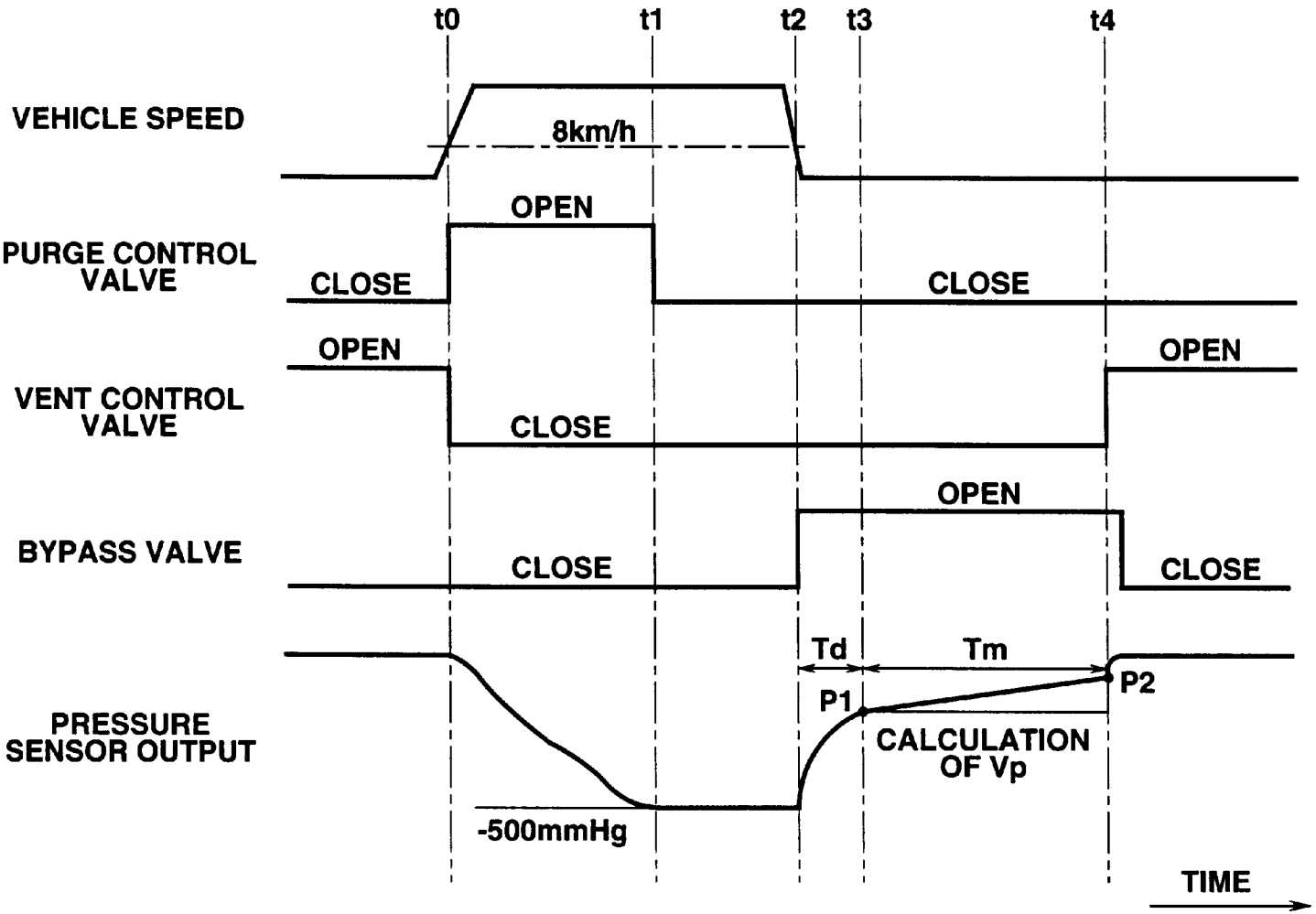
FIG. 4 is a timing chart illustrating operations of various valves and a variation of measurement value of a pressure sensor.

Operating conditions of the respective valves 11, 12 and 14 and variations of measurement pressure by the pressure sensor 13 resulting when the above described leak diagnosis is made are shown in FIG. 4.

As shown in FIG. 4, when the vehicle speed exceeds a predetermined value (i.e., 8 Km) at the time t0, the vent control valve 12 is closed and the purge control valve 11 is opened such that a vacuum is introduced into the portion of the conduits 2 and 6 between the closed bypass valve 14 and the intake pipe 8.

When the pressure in the conduit reduces to a predetermined value (i.e., −500 mmHg) at the time t1, the purge control valve 11 is closed. By this, the portion of the conduits 2 and 6 between the bypass valve 14 and the purge control valve 11 is closed so as to be in the form of a closed space, i.e., in a way as to prevent communication between the inside and outside thereof. In this instance, since the conduit 6 is provided with the vacuum storing tank 15, a sufficient amount of vacuum is stored in the portion of the conduits 2 and 6 between the bypass valve 14 and the purge control valve 11.

Then, when the vehicle speed becomes lower than the predetermined value (i.e. 8 Km/h) at the time t2, the bypass valve 14 is opened so that a vacuum is introduced further into the portion of the conduit 2 between the fuel tank 1 and the bypass valve 14. In this instance, the portion of the conduits 2 and 6 between the fuel tank 1 and the purge control valve 14 is closed so as to be in the form of a closed space, i.e., in a way as to prevent communication between the inside and outside thereof.

When the pressure in the conduit between the fuel tank 1 and the purge control valve 11 becomes stable after lapse of the delay time Td from the time t2 (i.e., at the time t3), the pressure P1 within the conduit 6 is measured. Further, after lapse of the measurement time Tm from measurement of the pressure P1 (i.e., at the time t4), the pressure P2 in the conduit 6 is measured once again to observe a pressure variation after the time t3. Based on the measurement pressures P1 and P2, a pressure variation speed Vp is obtained. A leak diagnosis is made by comparing the pressure variation speed Vp with a reference value.

While the present invention is similar to the prior art in that the portion of the conduits 2 and 6 between the fuel tank 1 and the purge control valve 11 is negatively pressurized, i.e., subjected to reduction of pressure and closed so as to be in the form of a closed space such that a leak diagnosis is made based on a variation of pressure in the closed space, it differs from the prior art in that the bypass valve 14 is closed during the time the purge control valve 11 is opened to introduce a vacuum from the intake pipe 8 (i.e., during the time from t0 to t1). Due to this, it never occurs that the fuel vapors in the fuel tank 1 are drawn into the intake pipe 8, thus making it possible to prevent variations of the air/fuel ratio and thereby prevent unstable operation of the engine.

Further, the portion of the conduit 2 between the fuel tank 1 and the bypass valve 14 is subjected to reduction of pressure by using the vacuum stored in the conduit 6 between the bypass valve 14 and the purge control valve 11. In this connection, the conduit 6 is provided with the vacuum storing tank 15 having a predetermined volume according to the present invention, so it can store a sufficient amount of vacuum for reduction of the pressure in the conduit 2.

Further, the reduction of pressure is carried out at high vehicle speed in which a high vacuum prevails in the intake pipe 8, so it can be attained within a short time and with efficiency. Further, since the leak diagnosis is made at low vehicle speed or at stoppage at which the leak diagnosis is hard to be influenced by sloshing, the accuracy of leak diagnosis can be improved.

The entire contents of Japanese Patent Application P10-248274 (filed Sep. 2, 1998) are incorporated herein by reference.

Although the invention has been described above by reference to a certain embodiment of the invention, the invention is not limited to the embodiment described as above. Modifications and variations of the embodiment described above will occur to those skilled in the art, in light of the above teachings. The scope of the invention is defined with reference to the following claims.

What is claimed is:

1. In an evaporative emission control system for an internal combustion engine including a canister having an atmospheric vent, a first conduit providing communication between a fuel tank and the canister, a second conduit providing communication between the canister and an intake pipe portion downstream of a throttle valve of the engine, a bypass valve disposed between the fuel tank and the canister and mounted on the first conduit for selectively allowing and preventing communication between the fuel tank and the canister, a purge control valve disposed between the canister and the intake pipe portion and mounted on the second conduit for selectively allowing and preventing communication between the canister and the intake pipe portion, and a vent control valve for selectively opening and closing the atmospheric vent of the canister, the evaporative emission control system comprising:

a pressure reducing device for closing said vent control valve and said bypass valve while opening said purge control valve for thereby introducing a vacuum prevailing in said intake pipe portion into a portion of said first and second conduits extending between said bypass valve and said intake pipe portion and thereby reducing a pressure in said portion of said first and second conduits to a predetermined value and thereafter closing said purge control valve;

a pressure measuring device for opening said bypass valve after reduction of said pressure in said portion of said first and second conduits to said predetermined value and measuring a pressure variation in a portion of said first and second conduits extending between said fuel tank and said purge control valve after lapse of a predetermined time from said opening of said bypass valve; and a diagnostic device for making a leak diagnosis on the basis of said pressure variation measured by said pressure measuring device.

2. An evaporative emission control system according to claim 1, further comprising a vehicle speed measuring device for measuring a vehicle speed of a vehicle on which said engine is installed, said pressure reducing device closing said vent control valve and said bypass valve while opening said purge control valve to introduce the vacuum prevailing in said intake pipe portion into said portion of said first and second conduits extending between said bypass valve and said intake pipe portion when the vehicle speed becomes higher than a predetermined value.

3. An evaporative emission control system according to claim 2, wherein said pressure measuring device opens said bypass valve when the vehicle speed becomes lower than the predetermined value after reduction of said pressure in said portion of said first and second conduits extending between said bypass valve and said intake pipe portion to the predetermined value.

4. An evaporative emission control system according to claim 1, further comprising a vacuum storing tank provided to said second conduit at a location between said bypass valve and said purge control valve.

5. In an evaporative emission control system for an internal combustion engine including a canister having an atmospheric vent, a first conduit providing communication between a fuel tank and the canister, a second conduit providing communication between the canister and an intake pipe portion downstream of a throttle valve of the engine, a bypass valve disposed between the fuel tank and the canister and mounted on the first conduit for selectively allowing and preventing communication between the fuel tank and the canister, a purge control valve disposed between the canister and the intake pipe portion and mounted on the second conduit for selectively allowing and preventing communication between the canister and the intake pipe portion, and a vent control valve for selectively opening and closing the atmospheric vent of the canister, the evaporative emission control system comprising:

a pressure reducing device for closing said vent control valve and said bypass valve while opening said purge control valve for thereby introducing a vacuum prevailing in said intake pipe portion into a portion of said first and second conduits extending between said bypass valve and said intake pipe portion and thereby reducing a pressure in said portion of said first and second conduits to a predetermined value and thereafter closing said purge control valve;

pressure measuring means for opening said bypass valve after reduction of said pressure in said portion of said first and second conduits to said predetermined value and measuring a pressure variation in a portion of said first and second conduits extending between said fuel tank and said purge control valve after lapse of a predetermined time from said opening of said bypass valve; and diagnostic means for making a leak diagnosis on the basis of said pressure variation measured by said pressure measuring means.

6. An evaporative emission control system according to claim 5, further comprising a vehicle speed measuring means for measuring a vehicle speed, said pressure reducing device closing said vent control valve and said bypass valve while opening said purge control valve to introduce the vacuum prevailing in said intake pipe portion into said portion of said first and second conduits extending between said bypass valve and said intake pipe portion when the vehicle speed becomes higher than a predetermined value.

7. An evaporative emission control system according to claim 6, wherein said pressure measuring means opens said bypass valve when the vehicle speed becomes lower than the predetermined value after reduction of said pressure in said portion of said first and second conduits extending between said bypass valve and said intake pipe portion to the predetermined value.

8. An evaporative emission control system according to claim 5, further comprising a vacuum storing tank provided to said second conduit at a location between said bypass valve and said purge control valve.

9. An evaporative emission control system in an automotive vehicle having a fuel tank and an intake pipe portion downstream of a throttle valve of an engine, the system comprising:

a canister having an atmospheric vent;

a first conduit providing communication between the fuel tank and said canister;

a second conduit providing communication between said canister and the intake pipe portion;

a bypass valve disposed between the fuel tank and said canister and mounted on said first conduit for selectively allowing and preventing communication between the fuel tank and said canister;

a purge control valve disposed between said canister and the intake pipe portion and mounted on said second conduit for selectively allowing and preventing communication between said canister and the intake pipe portion;

a vent control valve for selectively opening and closing said atmospheric vent of said canister;

pressure reducing means for closing said vent control valve and said bypass valve while opening said purge control valve for thereby introducing a vacuum prevailing in the intake pipe portion into a portion of said first and second conduits extending between said bypass valve and the intake pipe portion and thereby reducing a pressure in said portion of said first and second conduits to a predetermined value and thereafter closing said purge control valve;

pressure measuring means for opening said bypass valve after reduction of said pressure in said portion of said first and second conduits to said predetermined value and measuring a pressure variation in a portion of said first and second conduits extending between the fuel tank and said purge control valve after lapse of a predetermined time from said opening of said bypass valve; and diagnostic means for making a leak diagnosis on the basis of said pressure variation measured by said pressure measuring means.

10. A system according to claim 9, further comprising vehicle speed measuring means for measuring a vehicle speed, said pressure reducing means closing said vent control valve and said bypass valve while opening said purge control valve to introduce the vacuum prevailing in the intake pipe portion into said portion of said first and second conduits extending between said bypass valve and the intake pipe portion when the vehicle speed becomes higher than a predetermined value.

11. A system according to claim 10, wherein said pressure measuring means opens said bypass valve when the vehicle speed becomes lower than the predetermined value after reduction of said pressure in said portion of said first and second conduits extending between said bypass valve and the intake pipe portion to the predetermined value.

12. A system according to claim 9, further comprising a vacuum storing tank provided to said second conduit at a location between said bypass valve and said purge control valve.

* * * * *